US005191929A

United States Patent [19]

Kubota et al.

[11] Patent Number: 5,191,929

[45] Date of Patent: Mar. 9, 1993

[54] MOLTEN METAL SUPPLYING APPARATUS

[75] Inventors: Shoko Kubota; Sadayoshi Yamada, both of Zama, Japan

[73] Assignee: Toshiba Kikai Kabushiki Kaisha, Tokyo, Japan

[21] Appl. No.: 449,913

[22] PCT Filed: May 30, 1988

[86] PCT No.: PCT/JP88/00530

§ 371 Date: Jan. 5, 1990

§ 102(e) Date: Jan. 5, 1990

[87] PCT Pub. No.: WO89/00469

PCT Pub. Date: Jan. 26, 1989

[30] Foreign Application Priority Data

Jul. 9, 1987 [JP] Japan ..... 62-171927
Jul. 9, 1987 [JP] Japan ..... 62-171928

[51] Int. Cl.[5] ..... B22D 39/00

[52] U.S. Cl. ..... 164/500; 164/337; 164/316; 222/594; 266/237

[58] Field of Search ..... 164/500, 316, 136, 337, 164/133, 147.1; 266/237; 222/590, 591, 594

[56] References Cited

U.S. PATENT DOCUMENTS

| | | | |
|---|---|---|---|
| 2,224,982 | 12/1940 | Morin | 164/500 |
| 3,807,484 | 4/1974 | von Starck | 164/500 |
| 3,942,577 | 3/1976 | Uozumi et al. | 164/500 |
| 4,168,789 | 9/1979 | Deshais et al. | 164/316 |
| 4,216,800 | 8/1980 | Garnier | 164/500 |
| 4,635,706 | 1/1987 | Behrens | 164/500 |
| 4,714,102 | 12/1987 | Koya | 164/500 |
| 4,733,714 | 3/1988 | Smith | 164/337 |
| 4,789,020 | 12/1988 | Motomura | 164/500 |
| 4,842,170 | 6/1989 | Del Vecchio et al. | 266/237 |

FOREIGN PATENT DOCUMENTS

| | | | |
|---|---|---|---|
| 2248052 | 3/1973 | Fed. Rep. of Germany | 164/337 |
| 3528691 | 2/1987 | Fed. Rep. of Germany | 164/500 |
| 50-9527 | 1/1975 | Japan . | |
| 14337 | 2/1979 | Japan | 164/500 |
| 61-180666 | 8/1986 | Japan . | |

*Primary Examiner*—Richard K. Seidel
*Attorney, Agent, or Firm*—Banner, Birch, McKie & Beckett

[57] ABSTRACT

A molten metal supplying apparatus has an electromagnetic pump for supplying molten metal under electromagnetic forces through a molten metal feed tube to a die-casting machine. An adapter is provided for maintaining molten metal therein at the same surface level as that of molten metal which is kept in a molten metal holding furnace at a prescribed temperature. The molten metal holding furnace is movable toward and away from a molten metal receiving member of the die-casing machine. An oxidized layer is prevented from being formed in the molten metal as it is fed through the feed tube, and the feed tube can easily be inspected and serviced. An orifice member is disposed in the feed tube for supplying even a small amount of molten metal accurately to the molten metal receiving member.

12 Claims, 7 Drawing Sheets

MOLTEN METAL SUPPLYING APPARATUS

TECHNICAL FIELD

The present invention relates to a molten metal supplying apparatus for supplying a mold, using an electromagnetic pump, with molten metal that is maintained at a prescribed temperature in a molten metal holding furnace, in a vertical die casting machine, a horizontal die casting machine, a low-pressure die casting machine, or a gravity die casting machine, and more particularly to a molten metal supplying apparatus which is capable of preventing the temperature of molten metal from being lowered and also effectively preventing an oxidized layer from being produced on molten metal when the molten metal is supplied from a molten metal holding furnace into a mold or die, and which is also capable of supplying even a small amount of molten metal accurately into the mold.

BACKGROUND OF THE INVENTION

As disclosed in Japanese Laid-Open Patent Publication No. 61-180666, there has been employed in the art a molten metal supplying apparatus for supplying molten metal from a molten metal holding furnace into a mold or molten metal receiving member through a distribution tube system which has an electromagnetic pump. In one arrangement, the electromagnetic pump is disposed below the surface level of molten metal in the holding furnace According to another system, the electromagnetic pump is positioned above the surface level of molten metal in the holding furnace, and air pressure and the electromagnetic pump are relied upon to supply the molten metal from the holding furnace into the mold.

In the former structure, the distribution tube connecting the holding furnace and the molten metal receiving member is required to be adjusted to the construction of the molten metal receiving member, i.e., to the position of the mold or the like, and hence the distribution tube is complex in structure and many joints are employed. Accordingly, the danger of leakage of the molten metal somewhere in the distribution tube exists. Since the distribution tube is located below the surface level of the molten metal in the holding furnace, if the distribution tube has to be inspected or serviced, all of the molten metal must be removed from the holding furnace. Such a process is time-consuming, and hence is not preferable from the standpoint of the production efficiency.

The latter construction is not versatile as it can only be used with low-pressure die-casting machines. Inasmuch a the molten metal receiving member is positioned higher than the surface level of the molten metal in the holding furnace, when the molten metal is supplied from the holding furnace to the molten metal receiving member, part of the molten metal is brought into contact with air and hence oxidized. After the molten metal has been supplied to the mold, an excessive amount of supplied molten metal cannot fully be returned into the holding furnace, and is partly deposited on the inner peripheral surface of the distribution tube. The deposited molten metal is oxidized by contact with air, and the oxidized deposit narrows the molten metal flow passage in the distribution tube. As a result, the rate of flow of the molten metal through the distribution tube in a next casting process is varied. With the conventional molten metal supplying apparatus of the type described above, the molten metal holding furnace and the molten metal receiving member are fixed in position. When the molten metal is supplied, therefore, the distribution tube is expanded and contracted because of an increase in the temperature of the distribution tube. As a consequence, the durability of packings or sealing members attached to the joints of the distribution tube is reduced.

DISCLOSURE OF THE INVENTION

In view of the aforesaid shortcomings of the conventional molten metal supplying apparatus, it is an object of the present invention to provide a molten metal supplying apparatus which can prevent molten metal supplied from a molten metal holding furnace to a mold from producing oxidized layers, can prevent the temperature of the molten metal from being lowered, can stabilize the rate of flow of the molten metal supplied over a long period of time, and can supply even a small amount of molten metal accurately to the mold.

To achieve the above object, there is provided in accordance with the present invention a molten metal supplying apparatus comprising: a constant-level molten metal holding furnace; a linear molten metal feed tube for feeding molten metal from the constant-level molten metal holding furnace to a molten metal receiving member; an electromagnetic pump disposed in the molten metal feed tube; and an adapter disposed between a tip end of the molten metal feed tube and the molten metal receiving member including an injection sleeve and having a molten metal feed passage capable of keeping a surface level of molten metal therein at a position higher than the molten metal feed tube, the arrangement being such that while the molten metal feed tube is being filled with molten metal, the electromagnetic pump is actuated to discharge the molten metal from the molten metal feed tube to the molten metal receiving member.

The molten metal feed tube has a heater mounted on the outer surface of at least the tip end thereof.

According to the present invention, there is also provided a molten metal supplying apparatus comprising: a constant-level molten metal holding furnace; a linear molten metal feed tube for feeding molten metal from the constant-level molten metal holding furnace to a molten metal receiving member; and an electromagnetic pump disposed in the molten metal feed tube, at least the constant-level molten metal holding furnace being movable toward and away from the molten metal receiving member.

The molten metal supplying apparatus further comprises a linear actuator coupled to the constant-level molten metal holding furnace for moving the constant-level molten metal holding furnace toward and away from the molten metal receiving member.

The molten metal supplying apparatus further comprises a resilient member mounted on the constant-level molten metal holding furnace for resiliently moving the constant-level molten metal holding furnace toward and away from the molten metal receiving member.

The molten metal supplying apparatus further comprises wheels mounted on a lower end of the constant-level molten metal holding furnace for allowing the constant-level molten metal holding furnace to move toward and away from aid molten metal receiving member.

The molten metal supplying apparatus further comprises a mount on which the constant-level molten metal holding furnace is mounted, and a sole plate on which the mount is movable toward and away from the molten metal receiving member with a low coefficient of friction.

The molten metal supplying apparatus further comprises a plurality of leaf springs mounted on the sole plate and supporting the mount.

According to the present invention, there is further provided a molten metal supplying apparatus comprising: a molten metal holding furnace; and a molten metal feed tube for supplying molten metal from the molten metal holding furnace to a molten metal receiving member with an electromagnetic pump, the molten metal feed tube having a restriction in at least one location, the restriction having a cross-sectional area smaller than the cross-sectional area of a flow passage of the molten metal feed tube.

The restriction comprises an orifice member disposed in the molten metal feed tube.

The orifice member comprises a disc having at least one recess for reducing the cross-sectional area of the flow passage of the molten metal feed tube.

BEST MODE FOR CARRYING OUT THE INVENTION

Preferred embodiments of molten metal supplying apparatus according to the present invention will be described below in detail with reference to the accompanying drawings.

Figure 1:
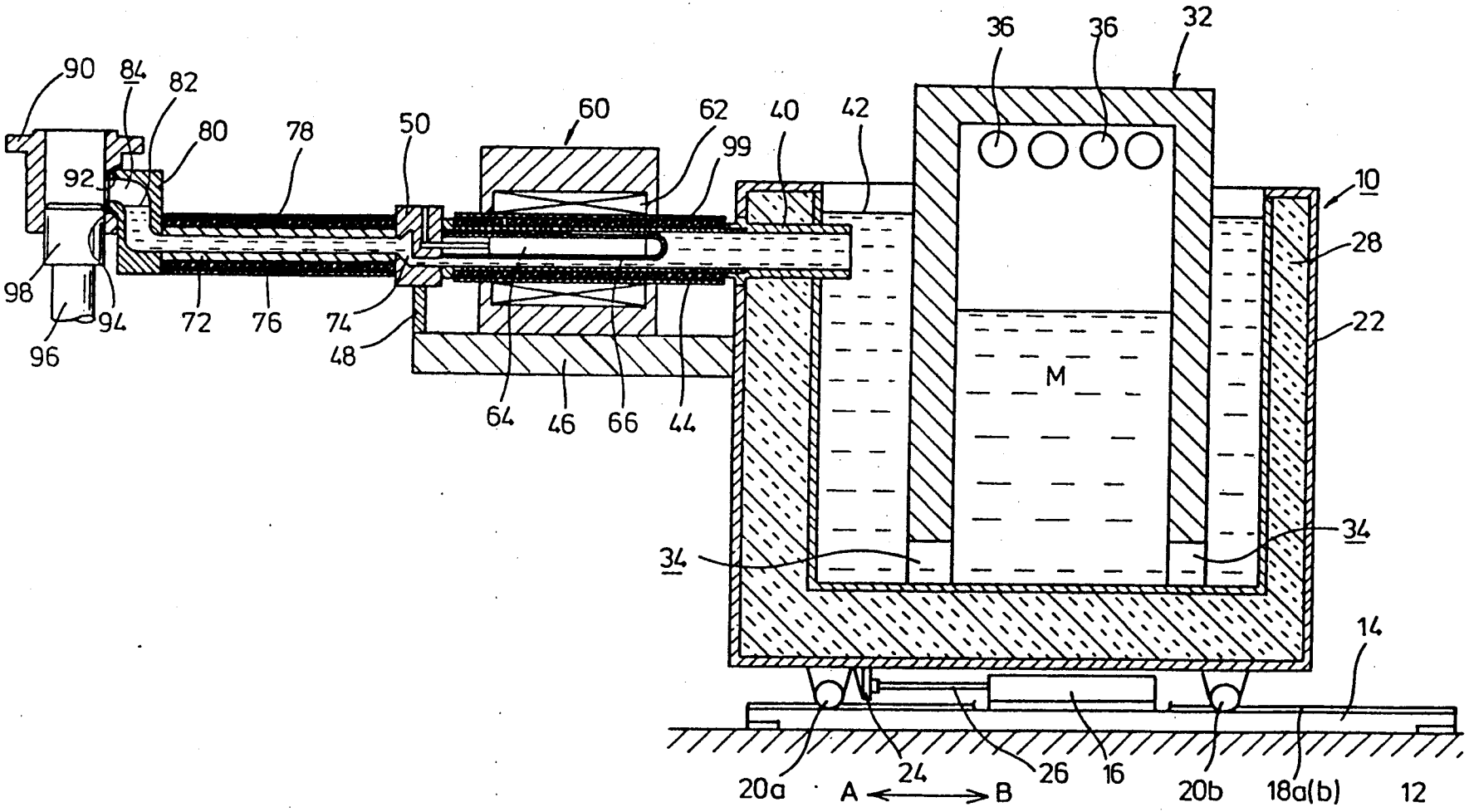
FIG. 1 is a vertical cross-sectional view of a diecasting machine in which a molten metal supplying apparatus of the present invention is incorporated.
Figure 2:
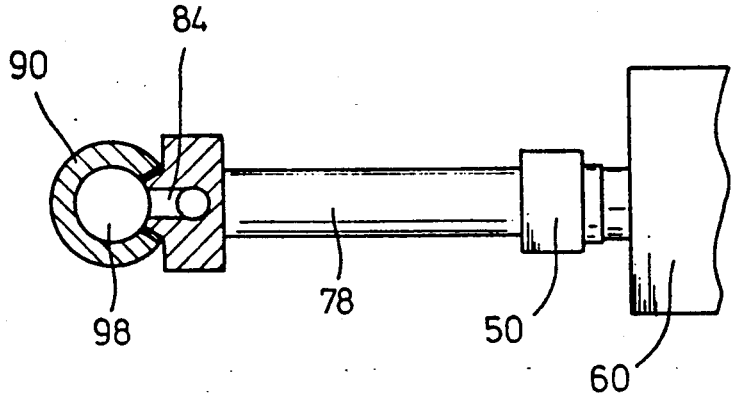
FIG. 2 is a horizontal cross-sectional view of an adapter and an injection sleeve of the molten metal supplying apparatus.

The reference numeral 10 in FIG. 1 represents a molten metal holding furnace for holding molten metal at a constant surface level. The molten metal holding furnace 10 is supported on a base 14 disposed horizontally on a floor 12. The base 14 supports thereon an air cylinder as a linear actuator, and has a pair of parallel rails 18*a*, 18*b* on its upper surface. Wheels 20*a*, 20*b* are rollingly mounted on the rails 18*a*, 18*b*, and support a casing 22 of the molten metal holding furnace 10. The casing 22 has an arm 24 projecting from the lower surface thereof and coupled to a piston rod 26 extending from the air cylinder 16.

The casing 22 has a wall containing a heat insulating member 28 which surrounds an inner space 30 that accommodates a constant-level molten metal holding furnace 32 substantially centrally therein. The constant-level molten metal holding furnace 32 has openings 34 in its lower end, and a plurality of heaters 36 in its upper portion. A horizontally extending molten metal discharge tube 40 is supported on the casing 22 near its upper end and extending into the inner space 30. As can easily be seen from FIG. 1, the molten metal discharge tube 40 is positioned slightly lower than the surface level 42 of molten metal maintained by the constant-level molten metal holding furnace 32. The molten metal discharge tube 40 has a tip end coupled to an intermediate feed tube 44.

A bracket 46 is horizontally mounted on a side wall surface of the casing 22, and arm stand 48 is vertically mounted on the distal end of the bracket 46. An iron core holder 50 is mounted on the arm stand 48. The intermediate feed tube 44 is held by the molten metal discharge tube 40 and the iron core holder 50.

An electromagnetic pump 60 is retained in position on the bracket 46. The electromagnetic pump 60 includes a coil 62 surrounding the intermediate tube 44 and an iron core 64 extending longitudinally in the intermediate distribution tube 44. The iron core 64 is surrounded by an iron core guard 66 which is heated to a prescribed temperature by an iron core guard heater. The iron core holder 50 has a passage 74 connecting a lower end of the intermediate feed tube 44 and an end feed tube 72, such that the molten metal discharge tube 40, the intermediate feed tube 44, and the end feed tube 72 are held coaxially with each other. A coil heater 76 is disposed around the tip feed tube 72 and surrounded by a cylindrical casing 78.

An adapter 80 is mounted on the distal end of the end feed tube 72. As shown in FIG. 1, the adapter 80 has an upstanding passage 84 for maintaining a surface level 82 of molten metal at the same height as that of the surface level 42 by the constant-level molten metal holding furnace 32. The passage 84 of the adapter 80 opens into a recess 92 defined in an injection sleeve 90 which opens into a mold or die (not shown). The recess 92 is of a hemispherical shape complementary to the hemispherical tip end of the adapter 80, with a seal member 94 interposed between the recess 92 and the tip end of the adapter 80. The molten metal discharge tube 40, the intermediate distribution tube 44, and the end feed tube 72 jointly constitute a molten metal supply tube. Denoted at 96 is a plunger, 98 a plunger tip mounted on the tip end of the plunger 96 and disposed in the injection sleeve 90, and 99 a heater wound around the intermediate feed tube 44.

The molten metal supplying apparatus is basically constructed as described above. Now, its operation and advantages will be described below.

Molten metal M stored in the holding furnace 10 has its surface level 42 maintained by the constant-level holding furnace 32 at a position slightly higher than the molten metal discharge tube 40, the intermediate feed tube 44, and the end feed tube 72. Therefore, the molten metal M reaches the adapter 80 through the molten metal discharge tube 40, the intermediate feed tube 44, and the end feed tube 72. The surface level 82 of the molten metal in the adapter 80 is consequently at the same height as that of the surface level 42. The heater 36 is energized to keep the molten metal in the constant-level holding furnace 32 at a prescribed temperature.

The electromagnetic pump 60 is actuated under this condition. As is well known, the electromagnetic pump 60 operates by inducing an electric current in the molten metal M in the intermediate feed tube 44 and generating an electromagnetic force with the induced current and a magnetic field produced by the coil 62 to forcibly move the molten metal M toward the injection sleeve 90. The molten metal M is discharged from the adapter 80 into the injection sleeve 90. A cylinder (not shown) is actuated to displace the plunger 96 in the direction of the arrow to enable the plunger tip 9 to push the molten metal forcibly into the mold or die (not shown). After a certain period of time has elapsed, a solidified casting can be produced from the mold.

According to the present invention, the molten metal discharge tube 40, the intermediate feed tube 44, and the end feed tube 72 are substantially linearly arranged, i.e., coaxially arranged. Therefore, the feed system for feeding the molten metal from the holding furnace 10 to the injection sleeve 90 is highly simplified. Since the joints of the feed system are few in number, the danger of leakage of the molten metal as it is fed is small. Because it is possible to substantially reduce the entire length of the molten metal discharge tube 40, the intermediate feed tube 44, and the end feed tube 72, any reduction in the temperature of the molten metal M when it is fed therethrough can be minimized. Such a temperature drop of the molten metal M can further be effectively prevented by the coil heaters 99, 76 disposed around the intermediate feed tube 44 and the end feed tube 72. With the present invention, the adapter 80 is mounted on the distal end of the end feed tube 72 for providing the same surface level of molten metal as that 42 of molten metal by the constant-level holding furnace 32. Therefore, it is possible to fill the molten metal discharge tube 40, the intermediate feed tube 44, and the end feed tube 72 with the molten metal M at all times. Accordingly, the molten metal M does not produce any oxidized layer as it is held out of contact with oxygen in the atmosphere. Defects in castings, which would otherwise be caused by such oxidized layer, are thus prevented. Furthermore, the problem of oxidized deposits on the inner peripheral surfaces of the tubes, which would narrow the diameters of the tubes and make the rate of flow of the molten metal through the tubes unstable, can also be prevented.

For inspecting and servicing the molten metal discharge tube 40, the intermediate feed tube 44, or the end feed tube 72, it is not necessary to remove all of the molten metal M from the holding surface since the constant-level holding furnace 32 is employed. Such an inspecting and servicing process can thus be performed easily. The air cylinder 16 is actuated to urg the casing 22 in the direction of the arrow A at all times during operation, for thereby pressing the hemispherical end of the adapter 80 into the recess 92 of the injection sleeve 90 under certain pressure. Even if the feed system is expanded by the heat of the molten metal supplied to the molten metal discharge tube 40, the intermediate feed tube 44, and the end feed tube 72, the adapter 80 is not loosened from the injection sleeve 90. As a consequence, no molten metal will leak from between the injection sleeve 90 and the adapter 80. By inactivating the air cylinder 16 to allow the casing 22 to be displaced in the direction of the arrow B, the molten metal discharge tube 40, the intermediate distribution tube 44, or the end feed tube 72 may easily be detached for inspection or servicing.

Figure 3:
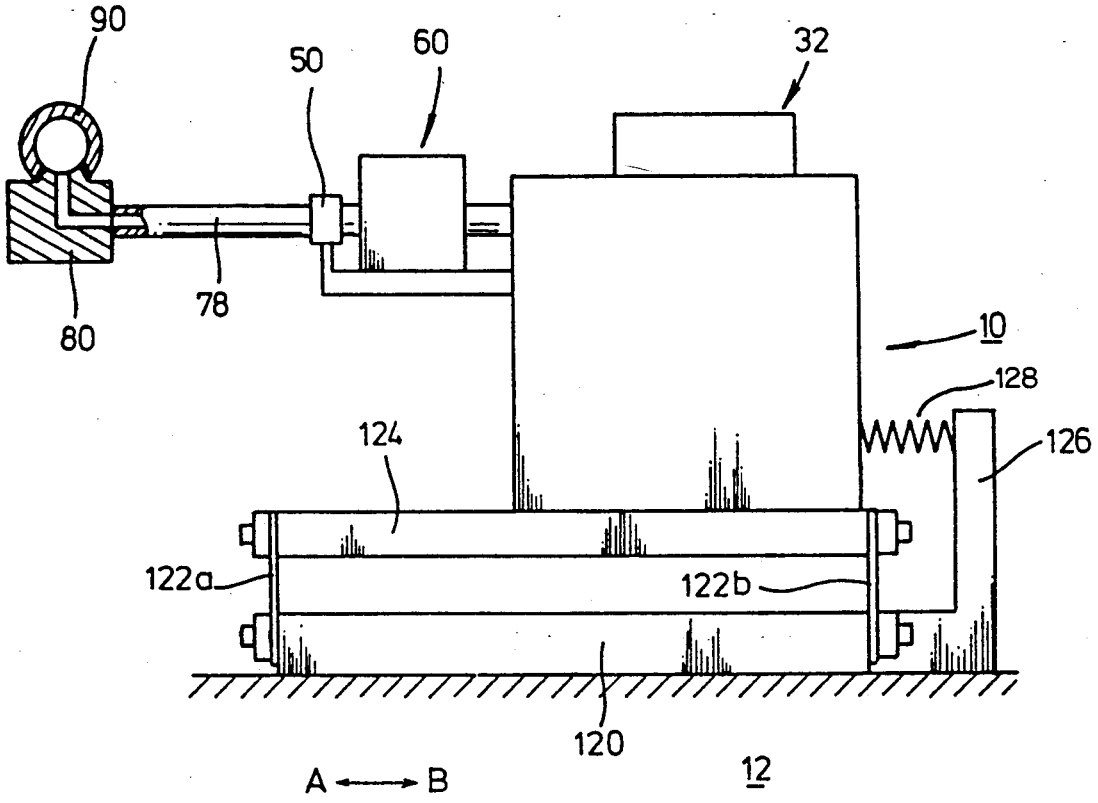
FIG. 3 is an elevational view of a die-casting machine incorporating a molten metal supplying apparatus according to another embodiment of the present invention

FIG. 3 shows a molten metal supplying apparatus according another embodiment of the present invention. Those parts in FIG. 3 which are identical to those shown in FIG. 1 are denoted by identical reference numerals, and will not be described in detail. This holds true for other embodiments or modifications.

In the embodiment of FIG. 3, a molten metal holding furnace 10 is not supported on any rails on a base, but is supported on a sole plate 120 directly mounted on a floor 12, the sole plate 120 being slidable on the floor 12 with a low coefficient of friction. A mount 124 is supported above the sole plate 120 substantially parallel thereto by leaf springs **122*a*, 122*b* mounted on the sole plate 120, and the holding furnace 10 is mounted on the mount 124. A pusher 126 of a vertically bent shape is coupled to one end of the sole plate 120. A coil spring 128 is held at one end against the upper distal end of the pusher 126, and has its tip end held against a side wall of a molten metal holding furnace 10 for normally urging the holding furnace 10** in the direction of the arrow A.

With this arrangement, even if the molten metal discharge tube 40, the intermediate distribution tube 44, or the end distribution tube 72 is heated by the supplied molten metal and substantially increased in its length, as described above, the tip end of he adapter 80 is held in intimate contact with the injection sleeve 90 so that they will not come apart.

FIGS. 4 through 9 show other embodiments of molten metal supplying apparatus according to the present invention. These embodiments are particularly directed to modified adapters 80.

Figure 4:
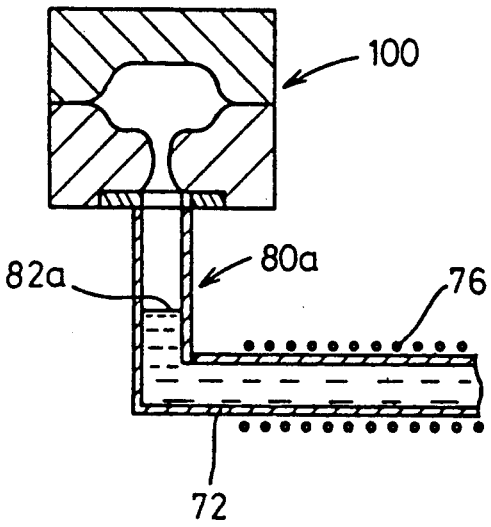
FIGS. 4 through 6 are vertical cross-sectional views of adapters according to other embodiments of the present invention.

FIG. 4 shows an arrangement for use with a low-pressure die-casting machine. The low-pressure die-casting machine has a mold or die 100 with its lower end attached to a bent stalk used as an adapter **80*a*. An end feed tube 72 is coupled to the lower end of the adapter 80*a*. Molten metal supplied to the adapter 80*a* has a surface level higher than the surface level 42** in the holding furnace.

Figure 5:
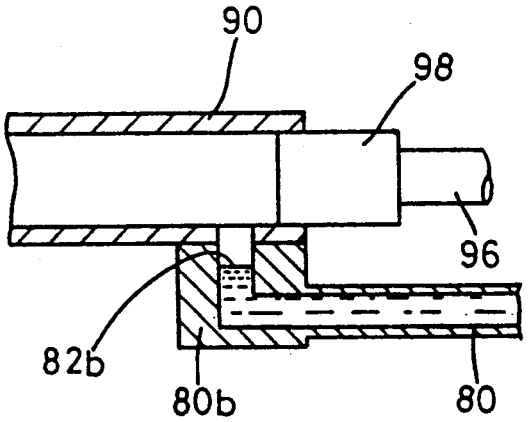

FIG. 5 illustrates an arrangement for use with a horizontal injection die-casting machine. An adapter **80*b* which is bent as with the first embodiment is coupled to and opens into an injection sleeve The surface level 82*b* of molten metal in the adapter 80*b* is higher than the surface level 42** in the holding furnace.

Figure 6:
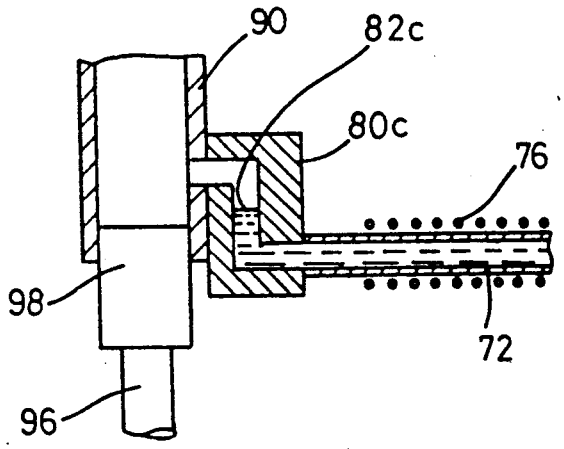

FIG. 6 shows a block used as an adapter **80*c* with a vertical die-casting machine. The surface level 82*c* of molten metal in the adapter 80*c* is higher than the surface level 42** in the holding furnace.

The adapters shown in FIGS. 4 through 6 offer the same advantages as those of the first embodiment.

Figure 7:
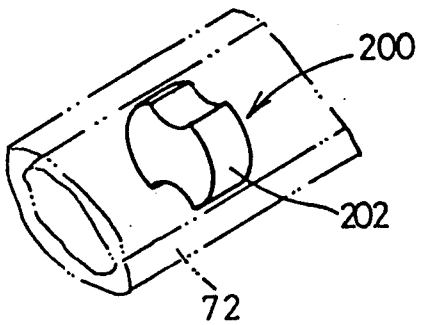
FIG. 7 is a perspective view of an orifice in the tip end of a feed tube of the apparatus according to to the present invention.
Figure 8:
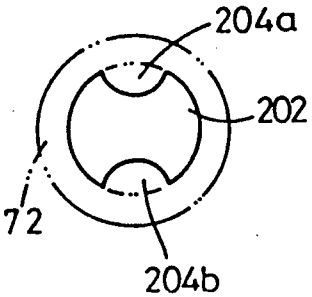
FIGS. 8 through 13 are front elevational views of orifices to be incorporated in the tip end of the feed tube according to the present invention.

FIGS. 7 and 8 show still another embodiment of the present invention. A substantially circular orifice member 200 is disposed in the end feed tube 72 and has a restriction of a cross-sectional area smaller than the cross-sectional are of the inner passage of the end feed tube 72. As shown in FIG. 7 and 8 the orifice member 200 comprises a disc 202 having the same outside diameter as the inside diameter of the end feed tube 72, the disc 202 having two upper and lower U-shaped or semicircular recesses **204*a*, 204*b* defined in its outer peripheral edge. The two recesses 204*a*, 204*b* prevent air from being stagnant in the end feed tube 72. Particularly, when the molten metal discharge tube 40, the intermediate feed tube 44, and the end feed tube 72 are emptied for inspection and servicing, the molten metal M is prevented from being left in these tubes. The orifice member 200** may be of any of various configurations.

Figure 9:
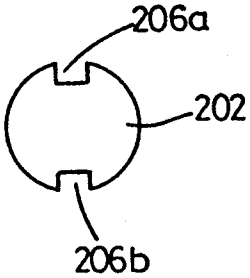

In FIG. 9, a pair of upper and lower rectangular recesses **206*a*, 206*b* is defined in a disc 202**.

Figure 10:
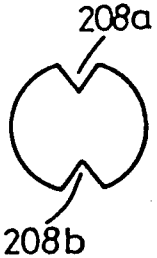

In FIG. 10, a pair of V-shaped recesses or notches **208*a*, 208*a* is defined in a disc 202**.

Figure 11:
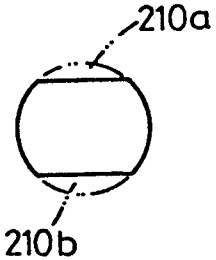

In FIG. 11, a disc 202 has a pair of segmental recesses 210*a*, 210*b*.

Figure 12:
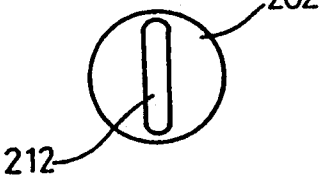

In FIG. 12, no recess is defined in the outer peripheral edge of a disc 202, but an oblong recess 212 is defined diametrically in the disc 202.

Figure 13:
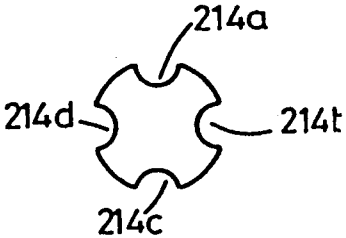

In FIG. 13, semicircular recesses 214*a* through 214*d*, similar to those shown in FIG. 8, are defined at angular intervals of 90°.

The orifice member 200 disposed in the end feed tube 72 offers the following additional advantages: Heretofore, when molten metal is discharged from the tip end of the adapter, the time in which the molten metal is discharged has been adjusted or the voltage applied to the electromagnetic pump 60 has been regulated. This conventional method has been unable to stabilize the amount of molten metal supplied. For example, it has been impossible to deliver molten metal M less than 500 g into the injection sleeve 90. According to the present invention, when supplying molten metal M into the injection sleeve 90, the orifice member 200 in the end feed tube 72 restricts the molten metal M thereby to stabilize the amount of supplied molten metal. When 500 g of molten metal M was fed according to the present invention, the error was about ±1.5%. In the illustrated embodiments, the orifice member 200 is disposed in the end feed tube 72. However, the orifice member 200 may be disposed in the molten metal discharge tube 40 or the intermediate feed tube 44. Alternatively, the orifice member may be disposed as a spacer sandwiched between the molten metal discharge tube 4 and the intermediate feed tube 44, or between the intermediate feed tube 44 and the end feed tube 72, or two more orifice members may be disposed in the feed system. The orifice member may have only one recess if there is a gap defined as an air bleeder between the outer periphery of the orifice member and the inner peripheral surface of the molten metal discharge tube 40, the intermediate feed tube 44, or the end feed tube 72 for allowing sufficient air to be released. Furthermore, the orifice member 200 may not be separate from, but may be made integral with, the molten metal discharge tube 40, the intermediate feed tube 44, or the end feed tube 72, or a structure similar to the orifice member 200 may be incorporated in the iron core holder 50.

INDUSTRIAL APPLICABILITY

With the present invention, as described above, a casting process is carried out while molten metal is being filled in the molten metal feed system between the molten metal holding furnace and the injection sleeve. Therefore, the molten metal is prevented from contacting air, and as a result no oxidized layer is produced in the molten metal or the temperature of the molten metal is prevented from being lowered. Since no oxidized layer is deposited in the molten metal feed system, the inside diameters of the feed tubes are not reduced, and hence the amount of supplied molten metal is stabilized. The danger of defects in produced castings is therefore minimized. The molten metal feed system, particularly the adapter, is movable toward and away from the injection sleeve. Under normal condition, the adapter is pressed against the injection sleeve during a casting process. Even if the molten metal feed system is expanded by the heat of the molten metal carried therein, no undue stress is applied to the components including the feed system since the adapter is pressed against the injection sleeve under prescribed pressure by the linear actuator which may be an air cylinder, a coil spring, or the like. Consequently, these components will not be broken or damaged. Inasmuch as the seal member disposed between the adapter and the injection sleeve is not damaged, no molten metal will leak from between the adapter and the injection sleeve. For inspecting or servicing the molten metal discharge tube, the intermediate feed tube, or the end feed tube, the molten metal holding furnace is displaced by inactivating the air cylinder or against the resiliency of the coil spring in order to remove these tubes easily from the injection sleeve or the molten metal holding furnace. Moreover, the restriction of a cross-sectional area smaller than the cross-sectional area of the passage in the molten metal feed system is provided in at least one location in the molten metal feed system. As a result, even when a small amount of molten metal is supplied, the amount of supplied molten metal is stabilized, and can be controlled highly accurately.

Although certain preferred embodiments have been shown and described, it should be understood that many changes and modifications may be made therein without departing from the scope of the appended claims.

We claim:

1. A molten metal supplying apparatus comprising: a constant-level molten metal holding furnace; a substantially linear molten metal feed tube for feeding molten metal from the constant-level molten metal holding furnace to a molten metal receiving member; an electromagnetic pump disposed in said molten metal feed tube; and an adapter disposed between a tip end of said molten metal feed tube and the molten metal receiving member including an injection sleeve and said adapter having a molten metal feed passage capable of keeping a surface level of molten metal therein at a position higher than said molten metal feed tube, wherein a longitudinal axis of said molten metal feed tube is disposed horizontally along a straight line and below a surface level of said molten metal maintained in said constant-level molten metal holding furnace; the arrangement being such that while said molten metal feed tube is being filled with molten metal, said electromagnetic pump is actuated to discharge the molten metal from the molten metal feed tube to said molten metal receiving member.

2. A molten metal supplying apparatus according to claim 1, wherein said molten metal feed tube has a heater mounted on the outer surface of at least the tip end thereof.

3. A molten metal supplying apparatus comprising: a constant-level molten metal holding furnace; a linear molten metal feed tube for feeding molten metal from the constant-level molten metal holding furnace to a molten metal receiving member; and an electromagnetic pump disposed in said molten metal feed tube, wherein a longitudinal axis of said molten metal feed tube is disposed horizontally along a straight line, and at least said constant-level molten metal holding furnace being movable toward and away from said molten metal receiving member.

4. A molten metal supplying apparatus according to claim 3, further comprising a linear actuator coupled to the constant-level molten metal holding furnace for moving the constant-level molten metal holding furnace toward and away from the molten metal receiving member.

5. A molten metal supplying apparatus according to claim 3, further comprising a resilient member mounted on the constant-level molten metal holding furnace for resiliently moving the constant-level molten metal holding furnace toward and away from the molten metal receiving member.

6. A molten metal supplying apparatus according to claim 5, further including a mount on which the constant-level molten metal holding furnace is mounted, and a sole plate on which the mount is movable toward and away from the molten metal receiving member with a low coefficient of friction.

7. A molten metal supplying apparatus according to claim 6, further including a plurality of leaf springs mounted on the sole plate and supporting the mount.

8. A molten metal supplying apparatus according to claim 3, further including wheels mounted on a lower end of the constant-level molten metal holding furnace for allowing the constant-level molten metal holding furnace to move toward and away from the molten metal receiving member.

9. A molten metal supplying apparatus according to claim 3, wherein said longitudinal axis of said molten metal feed tube is disposed below a surface level of said molten metal maintained in said constant-level molten metal holding furnace.

10. A molten metal supplying apparatus according to claim 3, wherein said molten metal feed tube has an orifice member disposed in at least one location inside said feed tube, said orifice member comprising a disk having a cross-sectional area smaller than the cross-sectional area of the flow passage of said molten metal feed tube, and said disk having at least one recess therein for reducing the cross-sectional area of the flow passage of said molten metal feed tube.

11. A method for supplying molten metal from an apparatus having a constant-level molten metal holding furnace; a substantially linear molten metal feed tube for feeding molten metal from the constant-level molten metal holding furnace to a molten metal receiving member, an electromagnetic pump disposed in said molten metal feed tube, and an adapter disposed between a tip end of said molten metal feed tube and the molten metal receiving member including an injection sleeve and said adapter having a molten metal feed passage capable of keeping a surface level of molten metal therein at a position higher than said molten metal feed tube, the method steps comprising:

filling said molten metal feed tube with molten metal; and actuating said electromagnetic pump, while filling said molten metal feed tube, to discharge the molten metal from the molten metal feed tube to said molten metal receiving member.

12. The method as recited in claim 11 wherein said molten metal feed tube includes a heater mounted on the outer surface of at least the tip end thereof and the method further comprises the step of heating said molten metal in said molten metal feed tube.

* * * * *